United States Patent [19]

Narcus

[11] 4,381,227

[45] Apr. 26, 1983

[54] PROCESS FOR THE MANUFACTURE OF ABRASIVE-COATED TOOLS

[75] Inventor: Harold Narcus, Worcester, Mass.

[73] Assignee: Norton Company, Worcester, Mass.

[21] Appl. No.: 309,668

[22] Filed: Oct. 8, 1981

Related U.S. Application Data

[62] Division of Ser. No. 174,076, Jul. 31, 1980, abandoned.

[51] Int. Cl.[3] ..... C25D 5/12; C25D 5/54; C25D 15/00

[52] U.S. Cl. ..... 204/16; 204/20; 204/40

[58] Field of Search ..... 204/16, 20, 40

[56] References Cited

U.S. PATENT DOCUMENTS

| | | | |
|---|---|---|---|
| 2,644,787 | 7/1953 | Bonn | 204/43 |
| 3,303,111 | 2/1967 | Peach | 204/38 |
| 3,485,725 | 12/1969 | Koretzky | 204/38 |
| 3,517,464 | 6/1970 | Mattia | 51/309 |
| 3,577,324 | 5/1971 | Patterson | 204/20 |
| 4,047,902 | 9/1977 | Wiand | 51/295 |

*Primary Examiner*—T. M. Tufariello
*Attorney, Agent, or Firm*—Rufus M. Franklin

[57] ABSTRACT

Abrasive products comprising abrasive grit particles bonded to a preferably flexible backing with nickel are produced by current assisted deposition from an electroless plating bath. The current is applied between a nickel containing anode and the abrasive substrate as a cathode at a preferred rate of between 2–150 amperes per foot of substrate area. The final deposition of metal is preferably carried out electrolessly. Process promotes uniform deposition of bond between abrasive grits in single layer on substrate.

1 Claim, No Drawings

PROCESS FOR THE MANUFACTURE OF ABRASIVE-COATED TOOLS

This application is a division, of application Ser. No. 06/174,076, filed July 31, 1980 now abandoned.

FIELD OF THE INVENTION

An improved flexible coated abrasive product and a process for production of electroplated abrasive products is disclosed.

BACKGROUND OF THE INVENTION

Electroplated abrasive products have been known in the art for many years. So called "electroless" plating has been used in producing such articles as indicated by U.S. Pat. Nos. 2,411,867; 3,488,166; 3,591,350; 3,629,922; 3,668,130; 4,079,552; and 4,160,049.

Electroless plating involves the use of a solution of the metal to be deposited which solution also contains a reducing agent capable, without the use of an electric current, reducing the metal so as to plate it on a suitable prepared substrate exposed in the solution.

The use of a electric current to assist the deposition of metal from an electroless plating solution is disclosed for specialized applications, unrelated to the production of abrasive products, in U.S. Pat. Nos. 2,644,787, and 3,577,324.

It is an object of the present invention to provide an improved technique for the codeposition of abrasive grain and metal bond on a suitable substrate. The process of this invention enables the production of thin flexible abrasive sheet material comprising abrasive particles bonded to a plastic film by a metal plating.

SUMMARY OF THE INVENTION

The present invention resides in the discovery that improved distribution of the metal on the substrate for bonding the abrasive grain can be achieved by subjecting the prepared substrate to a plating bath of the electroless type while at the same time applying a direct current through the bath with the substrate as the cathode and an electrode containing the plating metal being positioned in the bath as the anode. The current density in the case of a nickel plating electroless bath can be as low as from 1.5 to 5 amperes per square foot (1.4 to 4.6 $mA/cm^2$), should but preferably be from 50 to 100 amperes/$ft.^2$.

As a result of this technique, improved filling of the spaces between the abrasive grits is achieved, and the shadowing of areas of the substrate by grit particles is avoided. A uniform single layer coating can be readily achieved by the method of this invention.

Conventional electroless baths and pretreatments of the substrate such as taught in U.S. Pat. No. 4,160,049 may be used in carrying out this invention.

The abrasive grits, which may be diamond, cubic boron nitride, silicon carbide, alumina, co-fused alumina-zirconia, or even flint, may be allowed to settle from suspension onto the substrate or may be positioned adjacent the substrate as by a carrier or basket as shown in U.S. Pat. No. 3,957,593.

The backing may be any suitable flexible or inflexible conductive or non-conductive material adapted for the purpose. Particularly advantageous are flexible backings of wovemn fibers, and plastic films such as polyester resin.

SPECIFIC EMBODIMENT OF THE INVENTION

As an example of the present invention, a 4"×4" woven screen material (resin coated) being a non-conductor of electricity, was treated in the following manner:

(1) The resin-coated fiberglass screen form was sandblasted with #120 grit abrasive material to depolish the glossy surface of the film to achieve mechanical interlocking of the subsequent metallic abrasive-containing nickel deposit by creating microscopic cavities. Chemical etching may also be employed for accomplishing this same purpose—the etch formulation used depending upon the plastic substrate composition. For example, the familiar chromic acid-sulphuric acid formulation may be used for such plastics as acrylonitrile-butadiene-styrene (ABS) or polypropylene.

(2) Water rinsing the blasted part (3) Alkaline cleaning to remove residual blasting compound and any surface contamination (4) Water rinsing (5) Activation and accelerating pretreatment using the method of the Narcus patent U.S. Pat. No. 4,160,049 July 3, 1979. This pretreatment involves the employment of palladium-stannous chloride activators (colloidal solutions) and sulphuric acid-fluoboric acid mixtures (accelerators)

(6) Water rinsing (7) Application of an electroless nickel preplate coating for conductivity to the non-conductive surface. This is carried out at 80° F. to 100° F. for 10–20 minutes in the following alkaline electroless nickel bath:

Nickel sulphate—15 grams per liter
Nickel chloride—30 grams per liter
Sodium citrate—75 grams per liter
Ammonium chloride—50 grams per liter
Sodium hypophosphite—50 grams per liter
Distilled water 750 c.c. pH 8.5 to 9.0 by addition of 50–60 c.c. ammonium hydroxide If an acid-type electroless nickel bath is used, the following formulation is recommended:

Nickel chloride—30 grams per liter
Sodium hypophosphite—10 grams per liter
Sodium hydroxyacetate—50 grams per liter
Distilled water 900 c.c. pH 4.5 to 5.0

Temperature 190°–195° F. pH is lowered with a dilute sulphuric acid solution and raised with a dilute sodium hydroxide solution.

(8) After the above preplate of electroless nickel, a cathode lead connection is made to the now conductive surface and a bagged nickel anode is provided into the bath. The abrasive dispersion is now added to the bath in the matter known to the artisan.

A D.C. current of 5 amperes per square foot is applied for 10–20 minutes but a current of 50 to 150 amperes can be used for quicker plating with no deterioration in quality. The cathode connection is then removed in addition to removal of the nickel anode. Post-electroless plating is then continued in the same bath 1 hour without the use of the external source of D.C. current. The time is dependent upon the average size of the abrasive used. For example, a 320 grit diamond (52 micron size) requires a total time of two hours. Any available sized grit from 2 microns to 1000 microns may be employed. Synthetically produced polycrystalline diamond particles have been used—possessing greatly increased number of sharp points and cutting edges and lack of fracture planes.

The codeposit obtained (nickel matrix and abrasive) contains approximately 20–30% abrasive.

The nickel matrix reveals 88–93% Metallic nickel and 7–12% phosphorous.

The nickel matrix builds up to a height of approximately ½–¾ of the average abrasive height.

The coated woven-screen exhibits excellent ductility or flexibility.

Microscopic examination at 70 X reveals that the abrasive particles are arranged in a layer of a single particle thickness and not a pile-up of abrasive layers.

As previously noted, the grit blasting of the plastic coated substrate creates the minute cavities in the substrate providing for a stronger mechanical bond between the abrasive/metal composite and the substrate. These cavities form a pocket to receive a significant portion of the abrasive particle so that much of the diamond particle (½ to ¾ of its average height) is recessed out of the shear plane formed along the surface of the substrate—this factor in addition to the presence of the stronger bond of the codeposite to said substrate.

Other electroless nickels can be used in carrying out the present invention. These special electroless solutions are well known and often practiced by the artisan. Reference is made to the formation electrolessly of nickel coatings containing boron in lieu of phosphorus (the so-called nickel-boron coating) wherein the reduction is carried out using boron hydrides or amine boranes as the reducing agent to form this nickel deposit instead of sodium hypophosphite.

As other examples, ternary alloys such as nickel-cobalt-phosphorus, nickel-iron-phosphorus, nickel-copper-phosphorus, nickel-tungsten-phosphorus, nickel-molybdenum-phosphorus can be used as well as these similar ternary alloys containing boron instead of phosphorus.

Furthermore, in carrying out this invention, ternary alloys of the classification cobalt-ME-phosphorus (ME is the same metal as previously indicated) or cobalt-ME-boron, are also applicable.

The same technique as described above can be used to coat a woven glass fabric backing.

As another example for carrying out the invention, an optical fining pad for economically and efficiently grinding plastic or glass lenses is, as part of this invention, produced as follows:

A MYLAR panel 4"×4" in dimension and 0.005" (or) 0.0075" in thickness is grit-blased on one side only with #120 grit alundom to create microscopic cavities to insure mechanical interlocking of the subsequent nickel-diamond matrix, formed by this invention, to this MYLAR substrate. The sheet is pretreated as described in this application, i.e. cleaned in a suitable alkaline cleaner, activated and accelerated in the manner known to the artisan and then made conductive using an alkaline electroless or autocatalytic nickel without current applied as in a subsequent employed bath. This electroless or autocatalytic nickel coating is approximately 0.0002" thick and applied in 15–20 minutes in the aforementioned alkaline electroless nickel employed in the previous examples. The bath is operated between 90° F. and 100° F. for best deposition rates at a pH of 8.9–9.0.

The nickel-coated plastic panel is then made cathodic in the usual manner known to those engaged in the electroplating field and electrolytically plated in a standard (electrolytic) bright nickel plating bath for ½ hour at 2½ amperes per square foot to 5 ASF to form a sound foundation metallic nickel for further processing.

A specially-designed adhesive-backed rubber mask is applied, after thoroughly drying this nickel foundation metal, carefully and pressed tightly to the metallized substrate. The part is then "tacked" with diamond abrasive electrolytically in the open design areas of said mask in a manner known to those engaged in the diamond products industry; for example, a fine mesh basket to retain loose diamond. The amount of "tacking" time is dependent upon the diamond abrasive size. For example, 320 grit diamond (average 52 micron with an average diameter of 0.0019") is "tacked" to a build-up of 10% to 30% of its mean diameter height at 2½ ASF for 1½ to 4½ hours. The lower "tacking" time is preferred in order to maintain ductility or flexibility of the final MYLAR panel. The panel is then transferred, after washing and collecting the surplus diamond abrasive, to an alkaline electroless nickel plating bath, with the same electroless bath composition as previously employed but with current applied (50 to 150 amperes/-square foot) for further nickel deposition. A period of up to 20 minutes and a pH of 8.9 to 9.0 is usually required. Additional "tacking" or, in actuality, "post-plating", in the order of 10% to 20% of diameter build-up, occurs making a total "tacking" of 20% to 50% achieved. Here again, the lower figure is preferred for further maintenance of flexibility to the coated panel. Larger grit sizes, for example, 60 to 120 grit may require as high as 60% to 70% of "tacking" of the mean diameter height while smaller grit sizes (600–1200 grit) only 20% to 30%.

The adhesive-backed rubber mask (containing the design pattern) is then removed and the finished panel is then dried thoroughly is hot water and a hot air-blast. The result is a MYLAR panel with a nickel-diamond matrix in the desired selective areas suitable for use as an abrasive-coated tool, specifically, an optical fining pad for grinding plastic or glass lenses.

What is claimed is:

1. A flexible coated abrasive product comprising a non-conductive polymer film, a first conductive layer applied to one side of said film, a second, electrolytically applied, layer on said conductive layer, a third layer on said second layer, said third layer containing electrolytically applied nickel and, holding diamond abrasive particles to said second layer, a fourth layer electrolessly applied with electrolytic assistance of at least 50 amperes per square foot and containing, in addition to nickel, a combined element selected from the group consisting of boron and phosphorous and combinations thereof, said third and fourth layers amounting to 20 to 50% of the height of the diamond particles perpendicular to the plane of the backing.

* * * * *